United States Patent [19]

Webb et al.

[11] 4,257,039

[45] Mar. 17, 1981

[54] SMOKE DETECTOR

[75] Inventors: Norman J. Webb, Sacramento; David Bories, Fair Oaks, both of Calif.

[73] Assignee: Norma J. Webb, Sacramento, Calif.

[21] Appl. No.: 973,184

[22] Filed: Dec. 26, 1978

[51] Int. Cl.[3] ..... G08B 17/10; F21V 33/00

[52] U.S. Cl. ..... 340/629; 250/381; 340/326; 340/693; 362/253; 362/276

[58] Field of Search ..... 340/629, 628, 630, 693, 340/326; 250/573, 574, 381; 362/154, 184, 234, 253, 276

[56] References Cited

U.S. PATENT DOCUMENTS 3,728,706 4/1973 Tipton et al. ..... 340/629

3,964,036 6/1976 Adachi et al. ..... 340/629 X

*Primary Examiner*—John W. Caldwell, Sr.
*Assistant Examiner*—Daniel Myer
*Attorney, Agent, or Firm*—Mark C. Jacobs

[57] ABSTRACT

A smoke detector is battery operated and may employ an ionization chamber and/or an infrared detector. When the alarm circuit is actuated due to the presence of smoke levels above a predetermined value being sensed by the detector, the alarm is actuated and each of the built in lights is illuminated. An auxilliary light energizeable by said detector is adapted to disengage one of said lights electrically and to be energized at the same time the other of said lights is energized.

7 Claims, 8 Drawing Figures

SMOKE DETECTOR

BACKGROUND OF THE INVENTION

The present invention pertains to a smoke detector connected to an alarm circuit, which alarm is actuated by a sensor and the detector when a predetermined smoke level is exceeded. The smoke detector of this invention has particular utility in residential property since it is battery operated. The device is extremely beneficial for use in apartment houses which have long hallways and which may suffer from power outages should there be a fire.

The smoke detectors of this invention may employ either the photoelectric type of detector known to the art and currently employed in the Captain Kelly TM device sold by the Gilette Company of Boston, MA, as well as the ionization type of detector available in the marketplace under such trademarks as First Alert as sold by Pittway. Such ionization type detectors have been previously patented, for example in U.S. Pat. No. 3,728,706.

The photoelectric detectors utilize a beam of light which when interrupted by the cloudiness and the particulates of smoke actuate an alarm circuit. The ionization units, on the other hand, operate on the principal that an ionization current catalyzed by a radiation source is affected by the presence of particulate matter such as that found in smoke, which particulate matter reduces the current, and such reduction in current is detected and correlated with the density of the particulate matter to provide an indication of a smoke condition. As such the alarm is actuated.

The devices of this invention may employ either type of known detection system.

One of the problems associated with smoke and fire is the concept of panic, especially among children and elderly people. Ofttimes when one cannot visually determine the path of exit, especially after having been awakened from a sound sleep, people tend to panic in their haste to escape. It has been determined, therefore, that a lighted alarm system which includes one or more auxiliary lights to light the path of escape would be deemed beneficial.

Past experience has indicated that battery operated systems are preferred in order to avoid the necessity of reliance upon the presence of electricity.

Accordingly, it is an object of this invention to provide a smoke detector unit that is lighted at the sight of the detector and which includes at least one auxiliary lamp to be mounted distant from the detector in order to light the path of escape.

Another object is to provide a battery operated lighted smoke detector unit having a simultaneously generated light system.

Still another object is to provide a smoke detector unit having auxiliary detachable light means which are actuated by the sounding of the smoke alarm.

Other objects of the invention will in part be obvious and will in part appear hereinafter.

The invention accordingly comprises the apparatus possessing the construction combination of elements and arrangement in parts which are exemplified in the following detailed disclosure and the scope of the application of which will be indicated in the appended claims.

SUMMARY OF THE INVENTION

The present invention pertains to a battery operated smoke detection device which includes a built in light and has at least one auxiliary or secondary light connected thereto and operable therefrom.

The alarm circuit is adapted to not only actuate the alarm, but also to energize the lights forming part of this invention. A typical alarm circuit would employ a high impedance coupling means such as a MOSFET to sense the resistive changes in the sensing chamber of the ionization detector and to trigger a switch to turn on the alarm. Deactivation means reset the switching device, shutting off the alarm and the lights connected thereto after a predetermined time from when the alarm and lights have been turned on. Such a system is disclosed in U.S. Pat. No. 3,934,145, issued to Dobranski and Hart.

When the alarm circuit is actuated, the built in light goes on and the auxiliary or secondary lights connected to the smoke detector are also actuated. After the predetermined time, when the alarm ceases to sound, the lights also are turned off.

If desired, a low battery level detection circuit may also be included. Such low battery level detection circuit would operate both the alarm and the lights of this invention.

For a fuller understanding of the nature and the objects of this invention, reference should be had to the following detailed description taken in connection with the accompanying drawings.

DESCRIPTION OF THE PREFERRED EMBODIMENT

Figure 1:
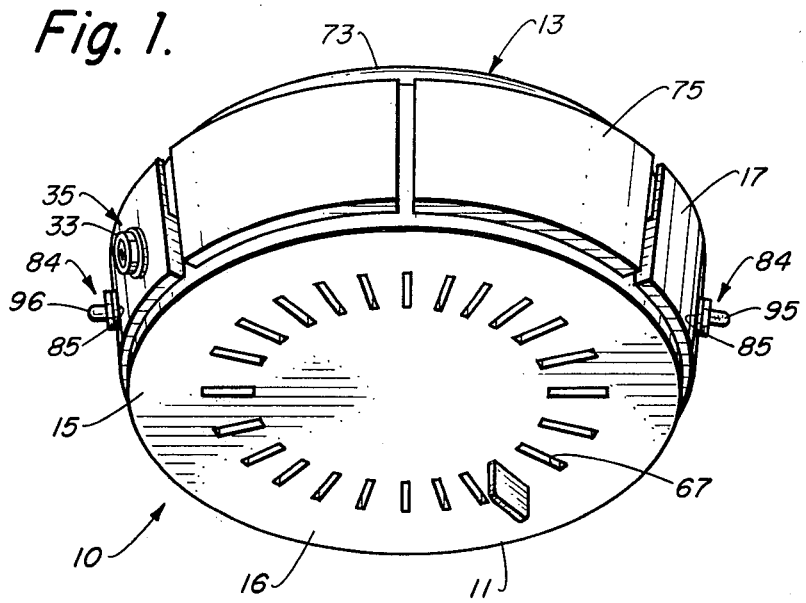
FIG. 1 is a perspective view showing the exterior of the smoke detector of this invention as it appears in a suspended condition when viewed from below.

FIG. 1 illustrates a perspective view of one form which the smoke detector of this invention may take. While shown to be round, it is also within the scope of the invention to employ a square, rectangular or other convenient shaped housing.

The smoke alarm generally designated 10 has a housing 11 that can be injection-molded from a material such as polypropylene or which can be formed from a metal such as aluminum. The housing here has a generally cylindrical shape and may have a diameter within the range of 6 to 10 inches in order to accommodate all the components needed for the self-contained independently operative smoke detection system.

The housing 11 is comprised of a base 15 and a cover 13. On the underside of the base 15 are a series of slots disposed in a circle radiating outwardly from the center of the underside of said base. Said slots 67 extend through the housing wall to provide communication between the ambient environment surrounding the detector and the interior of the detector. These slots 67 are adapted for the passage of smoke to the detector system mounted in the interior of housing 11 and for the audible dissemination of the signal from the alarm system also housed within the interior of housing 11.

Side wall 17 of base 15 is sloped and the ridges away from the flat bottom 16 of base 15. Side wall 17 has slits 18 which are also adapted to capture smoke when the smoke detector is mounted flush against a wall or ceiling. Cover 13 includes a generally flat portion 73 having mounting holes 77 therein. Cover 13 further includes a downwardly depending circular wall 75 having a plurality of mating tangs 69 mounted thereon.

Base 15 and cover 13 are held together by any suitable means. However, in this preferred embodiment the mating tangs 69 and groove members 71 in the cover and on the base respectively are utilized to form a convenient twist-lock for installing and removing the base from the cover. Access to the interior of the housing is seen therefore to be relatively simple. Smoke alarm 10 is mounted upon the ceiling or wall using conventional mounting screws which are disposed through mounting holes 77 in the cover 13.

Base 15 also serves as the structure to which each of the internal components that require mounting are fastened and in which the remaining components, which merely lie in place, are disposed. For example, the battery, 32 which is connected to the circuit board 23 by leads 29 is connected to battery connector 31. Such battery would rest within the interior concave portion of base 15. For further illustration it is seen that buzzer 27 and ionization chamber 28 are also mounted within base 15.

Stand-offs 19 are disposed vertically from the interior side of the bottom 16 of base 15. Each of said stand-offs include a threaded hole 20 for receiving screws 21 which hold circuit board 23 in place on said stand-offs 19. Cardboard cover 25, shown here with its interior cut away to better illustrate the circuit board 23 and the mounting thereof, is an optional cover utilized here for dust protection and for the attachment of such indicia as serial number, Underwriters Laboratories approval and general instructions. Such indicia may also be mounted on the underside of the flat top 73 of cover 13.

While the alarm means 27 has been indicated to be a buzzer connected to base 15, it is also within the scope of the invention to employ a bell or horn or any other device to produce ample warning sound.

Mounted in the center of the base 15 are the principal components of the smoke detector, including a sensing chamber of the ionization type, 28, and the alarm circuit which is embodied in printed circuit board 23. The chamber 28 is mounted directly beneath the circuit board 23 and said chamber is only partially visible in this figure. Since the chamber is a recognized prior art component, it is deemed unnecessary to reproduce same in the Figures of this application. The circuit board 23 as has been indicated is mounted on stand-offs 19. Leads 29 connect battery terminal plate 31 to the circuit board. Battery 32 is shown to be a 9 volt battery readily available in the marketplace, is employed as the energy source for the smoke detector of this application. The balance of the electrical components are found mounted on or a part of the alarm circuit board.

Suffice it to say that ionization chamber 28 comprises a plastic housing that is slit to permit entrance of smoke and particulates and which contains therein a metallic shell which serves as an anode, a ground or negative electrode and a radiation source. The anode, or positive terminal, is connected to the circuit board in order to receive power.

Figure 3:
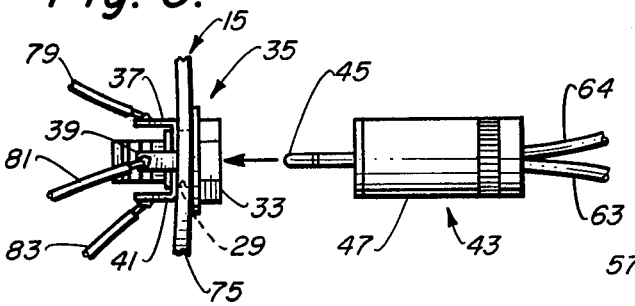
FIG. 3 is a fragmentary view showing the mode of connection of the auxiliary lights forming part of this invention.
Figure 4:
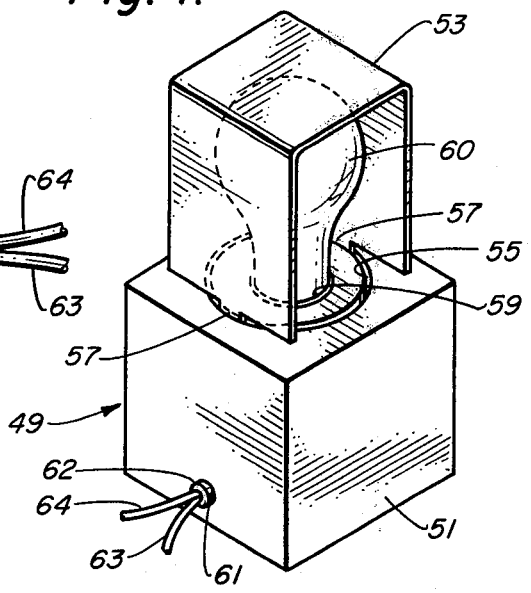
FIG. 4 is a perspective view of the auxiliary light forming part of this invention.

Turning now to FIG. 3, there is shown a top plan view of the auxiliary light connecting means per. This means comprises a plug 43 which electrically connects to jack 35. The auxiliary light, as best seen in FIG. 4, is connected by leads 63 and 64 are connected to body 47 and tip 45 of male plug 43. Female jack 35 is mounted through aperture 29 onto sidewall 75 of base 15 by nut 33. Leads 79, 81 and 83 are seen to be attached to terminals 37, 39 and 41 respectively. The electrical operation of the lighting system will be explained infra.

In FIG. 4 there is shown a typical wall mountable light means 49 comprising a base 51 having an aperture 61 on one side of said base for entry of leads 63 and 64. In order to prevent fraying of the leads, a grommet 62 is inserted in said aperture 61. These leads are electrically connected to bulb socket 59.

Figure 5:
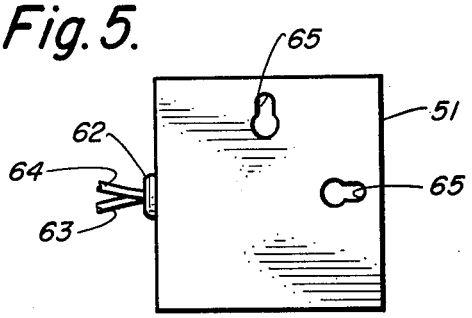
FIG. 5 is a bottom plan view of the light of FIG. 4.

On the top surface of lamp base 51 positioned in the center thereof is circular track 55. Circular track 55 comprises a groove downwardly extending into the body of said lamp base 51. Hood 53 is seen to include tab member 57 which project downwardly from the hood. These may be integrally manufactured with the hood if said hood constitutes a metal stamping, or said tabs 57 may be a separate component and secured by suitable fasteners such as rivets or screws to said hood 53. Tabs 57 are frictional engaged within track 55 to retain hood 53 in close proximity to said base 51. Rotation of the hood 53 allows light from the bulb, 60 electrically connected to socket 59 to be emitted in the direction desired. Shown in FIG. 5 on the underside of base 51 are a plurality of hanging means for detachably securing the base to a wall. Such hanging means 65 are well known to the art and are used in conjunction with a screw or nail head which has been previously pounded into the wall.

Suffice it to say that if smoke enters the sensing chamber, the collisions between the alpha particles from the source of the radiation and the oxygen and nitrogen molecules of the air are reduced because these collisions now occur with the relatively larger and heavy combustion products and particulate matter suspended in the smoke. While ionization of the combustion products and particulate matter may also occur, the rate at which the heavier positively charged ions move through the negatively charged electrode is less than that of the nitrogen and oxygen ions, and greater neutralization of the ions before they reach the anode occurs. Reduced collisions, reduced numbers of ions and reduced speed of the heavier ions all contribute to an overall reduction in the ionization current and an apparent increase in the resistance of the chamber 28. It is this decreased current, or increased resistance, at a particulate smoke level which is utilized to trigger the alarm system 27 of this invention.

Figure 6:
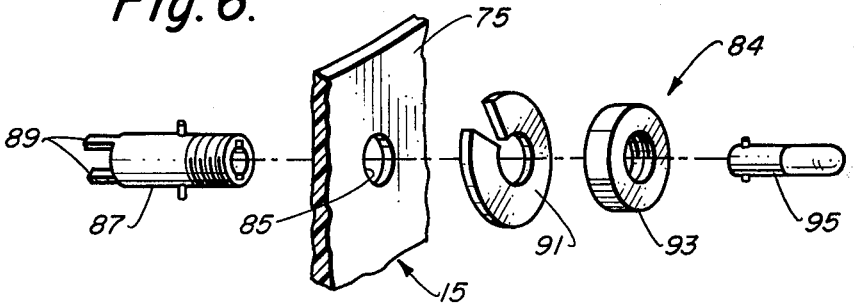
FIG. 6 is a fragmented view showing the details of the built in light of the smoke detector.

In FIG. 6 there are shown the details of the built in lights 84. The smoke detector of this invention is seen to include at least one of these built in lights 84. In the embodiment depicted herein two such lights are disclosed, though more could be included if desired. Bayonnet socket 87 is secured through aperture 85 in the downwardly depending wall 75 of base 15 by threadable nut 93 which has lock washer 91 interposed between said nut and the threaded portion of socket 87. Bayonnet mounting bulb 95 is engaged within socket 87 to make electrical contact. The terminals are shown to be 89.

In the preferred embodiment, there are two lights 84 disposed upon the sidewall of said base 180° apart such as to illuminate the hall or room on both sides of the detector.

Figure 7:
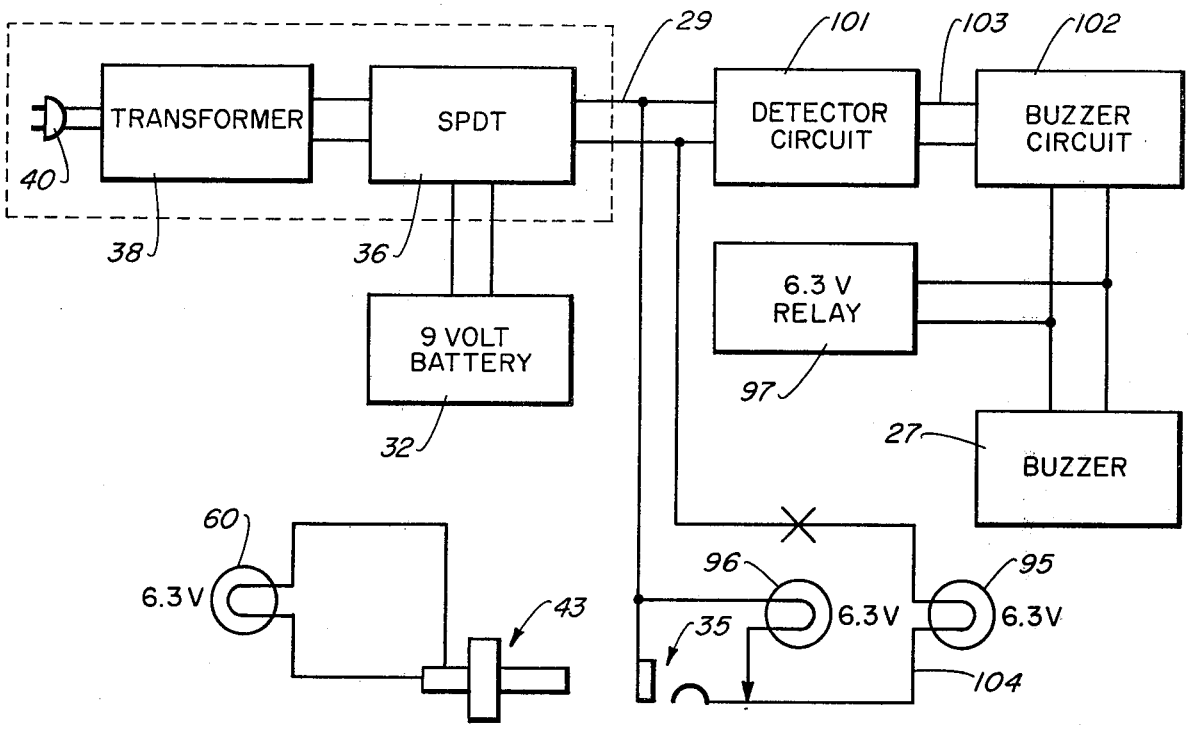
FIG. 7 is an electrical diagram of the detector and the lighting used in conjunction therewith for one embodiment of the invention.
Figure 8:
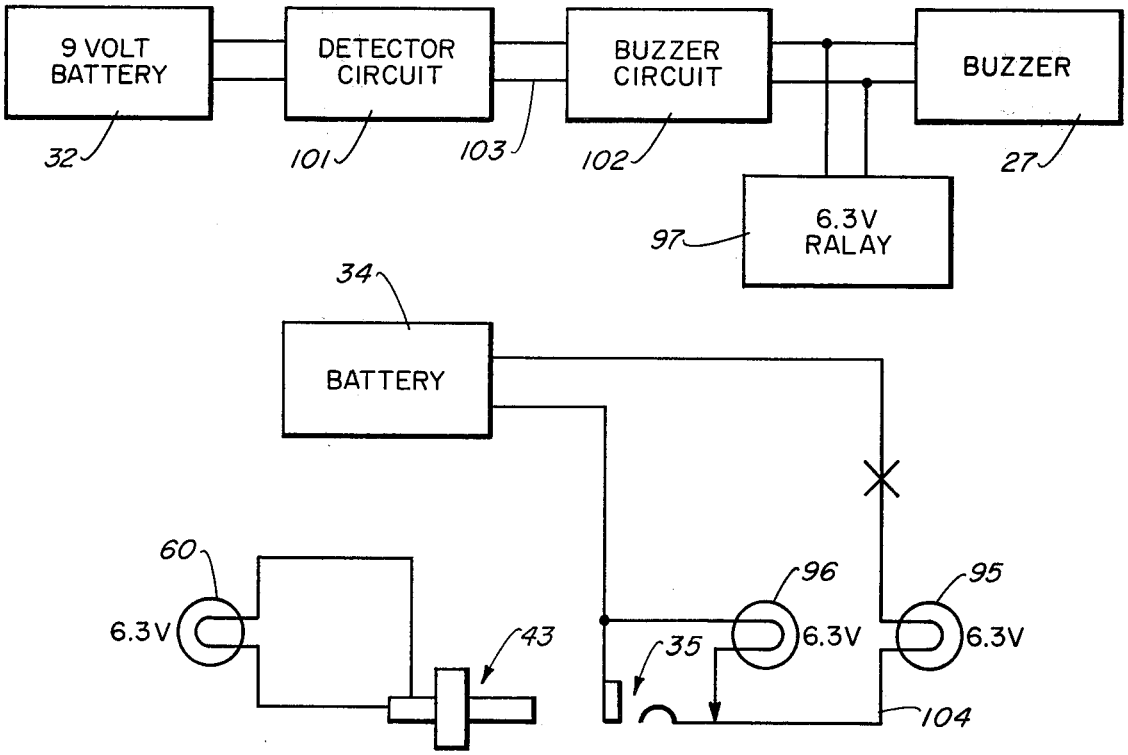
FIG. 8 is an electrical diagram of an alternate embodiment of this invention.

FIG. 7 is a combination electrical and block diagram showing the major components of the smoke detector of this invention and illustrating the light system of one embodiment as employed herein. The second embodiment is depicted in FIG. 8 infra. Since the actual detection circuit does not form part of this invention and is known to the art, such circuit has been collectively designated as 101 and shown merely as a black box. A typical detection circuit employable herein may be found in U.S. Pat. No. 3,934,145 to Dobrzanski et al. This circuit is merely illustrative of those unknown to the art. The circuitry to actuate the alarm, including the components for coupling the sensing chamber 28 to the alarm 27, and for triggering the alarm when the smoke condition exceeds a predetermined level are all collectively shown as alarm circuit 102. Here again such circuitry is known to the art and a typical one from the art can be found in the previously cited Dobrzanski patent.

In this diagram a 6.3 volt 37 ohm winding relay 97 is shown connected in parallel between the alarm circuit and the buzzer 27. Battery leads 29 are shown to be electrically connected to the detector circuit 101 which is in turn electrically connected to the alarm circuit 102 by leads 103.

Light bulb 95, a 6.3 volt miniature bulb, is seen to be connected electrically to the relay 97, and to jack 35 by lead 104. Bulb 96 is also connected to lead 104 and the jack on one side and to battery connection 29 on the other side.

Figure 2:
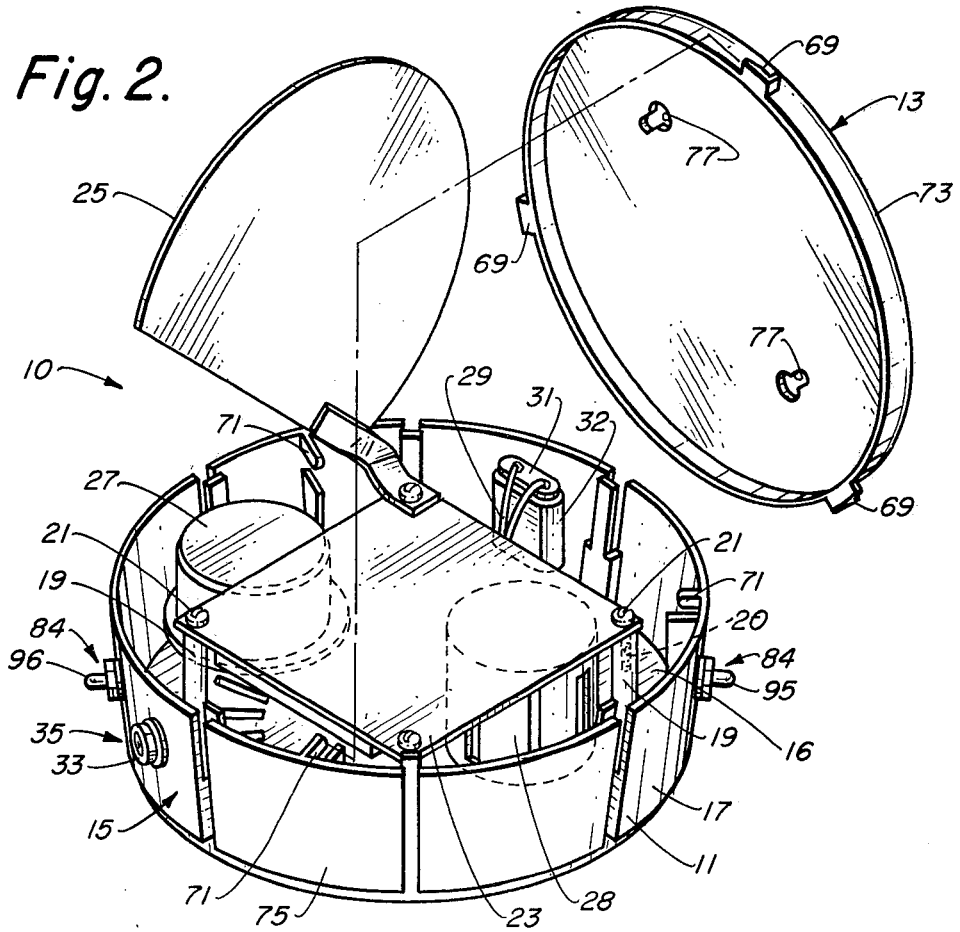
FIG. 2 is a top plan view of the detector with the cover or upper portion of the housing removed to show the interior components.

The wiring diagram as shown provides for the illumination of bulb 95 whenever the smoke level predetermined is reached such that a buzzer 27 is sounded. Light 96 will also be activated at such time. If, however, plug 43 is inserted into jack 35, bulb 96 is disengaged such that bulb 60, 6.3 V is actuated in its place at such time as bulb 95, the first primary bulb, becomes illuminated. Such a scheme provides for the use of the auxiliary bulb 60, if desired, or for that direction of the hallway to be lit by the second primary bulb 96. It is seen from this Figure that the alarm in toto is to be powered by 9 volt battery 32, or in the alternative, by AC current. The AC current is obtained from line and plug 40 electrically connected to transformer 38, which in turn is connected to single pull double throw (SPDT) switch 36 to which is also connected to said battery 32. Use of SPDT switch 36 interposed between connection lead 29 and battery 32 allows the device of this invention to be alternatively powered, but powered at all times. Obviously the use of the SPDT and the step down transformer 38 are optional and do not directly contribute to the operation of the device in question. Thus, in an alternative version battery 32 would be directly connected to leads 29 as is specifically provided for FIG. 2. It is for this reason that the switch and the AC line are shown in a dotted circle representing optional means.

In FIG. 8 there is disclosed an alternate power circuit. The detection light actuation and alarm circuitry are all similar. In this embodiment the lights are separately powered by battery 34 while the detector and alarm system are powered by battery 32. The benefit of the dual battery embodiment herein is to provide greater lamps for better visibility. In addition, the provision for a second battery 34 extends the life of the battery 32, since the lights which draw a reasonable amount of power are not being powered by said battery 32.

While not specifically shown in the figures as a separate embodiment, it is readily seen that the switch means and transformer connected to AC current can be inserted into the circuit of FIG. 8 to alternatively power the alarm portion of that detector, with the lights being separately powered, if desired.

It is seen that the lighted smoke alarm of this application provides a means not just for the immediate area of the smoke alarm to be lit, but indeed the length of a hallway since the two primary light sources 95 and 96 are spaced 180° apart on the generally depending side wall of the instant smoke alarm. It is seen therefore that not only is the hall lit in the immediate vicinity of the alarm, but both directions along the length of the hallway can be bathed in light from the activation of the smoke alarm. In addition, by use of the auxiliary lamp, a section of the hallway distant from the alarm can also be bathed in light. Such an application would find utility for a stairwell wherein the residents of a home or apartment house would require the stairwell, as well as the hallway, to be lit by the light eminating from the alarm device.

While only one auxiliary lamp and one jack means are shown in the Figures and in the discussion, it is obvious to one of ordinary skill that two auxiliary lamps could be used to bathe long hallways in light upon the actuation of the alarm. One would merely electrically connect in parallel a second bulb 60 to be operatively engaged upon insertion of the single master plug 43 into jack 35.

While the embodiment in the Figures has been shown to be circular in configuration, it is obvious that a rectangular or square configuration may be employed for both the cover and the base. In such instance, the two primary lights, 95 and 96, would still be disposed at 180° apart in order to bathe both directions away from the alarm.

While not specifically disclosed herein in the electrical circuitry, it is seen to be within the skill of the art to include a low-voltage detection circuit which detects a weakening battery and triggers the alarm, preferably in a pulsating fashion.

To trigger the buzzer 27 into operation when the smoke condition exceeds a predetermined level and thus causes the resistance of the sensing chamber 28 to increase, the voltage of certain transistors drops correspondingly. This is known and understood in the art. By programming the anode voltage of one of the key transistors, the smoke level, which activates the device, can be adjusted. Thus, the alarm signal can be sounded as soon as the smoke level in chamber 28 reaches a predetermined value. Means can be employed to eliminate spurious transients which might inadvertently turn the alarm on.

To prevent the buzzer 27 from remaining latched on if the smoke level drops below the level which triggered the alarm signal, or to cycle the alarm on and off in the presence of a continuing smoke condition, a pulsating circuit may be provided which deactivates the alarm at a fixed interval after it is turned on. Such latching means are generally provided for in the currently available smoke alarms, and as such is to be considered within the skill of the art.

Since certain changes may be made in the above apparatus without departing from the scope of the invention herein involved, it is intended that all matter contained in the above description and shown in the accompanying drawings shall be interpreted as illustrative and not in a limiting sense.

We claim:

1. In a smoke detector having a housing consisting of a base and a cover, and having a smoke sensing chamber, means to activate an alarm upon the sensing of a predetermined smoke level by the sensing chamber, and an alarm, all of which are mounted in the base of said housing;

said base having at least one downwardly side wall, and a bottom wall, the improvement comprising:

a pair of lamp sockets, each mounted generally normal to said side wall, and disposed 180° apart from each other on said side wall, each socket having an electric light bulb therein adapted to be lit when said sockets are energized, each of said sockets being electrically connected to;

a means to energize said sockets when the alarm sounds and deenergize said sockets when the alarm ceases;

whereby a path of egress from the vicinity of said smoke detector is lighted when the detector detects smoke and sounds the alarm.

2. In the smoke detector of claim 1 further including: an auxiliary light means comprising a lamp in a socket electrically connected to a plug, said socket being wall mountable, and an electrical jack mounted on the side wall of said base proximal to a first of said pair of sockets, and electrically connected to electrically disconnect said first of said pair of lamp sockets on said base, when said auxiliary light means' plug is inserted into said jacket, said auxiliary light means being plugged into said jack;

whereby upon the sounding of the alarm due to smoke detection, the second of said pair of lamps is energized and the auxiliary lamp means is energized, thereby lighting a path of egress from the vicinity of the smoke detector.

3. In the smoke detector of claim 2 wherein the auxiliary light means further includes a wall mountable base adapted to receive said electrical socket, said wall mountable base having a top surface with a circular track therein, and a lamphood rotatably secured to said base by frictional engagement of a portion of said hood with said track.

4. In the smoke detector of claim 2 wherein the smoke sensing chamber is an ionization chamber.

5. In the detector of claim 4 further including a SPDT switch connected to said battery and to a transformer connected to an AC current to alternatively power said detector.

6. In the smoke detector of claim 4 wherein said alarm and said lights are powered by separate batteries.

7. In the smoke detector of claim 6 further including a SPDT switch and a transformer connected to the battery that powers the alarm and to a transformer connected to AC current to alternatively power said alarm portion of said smoke detector.

* * * * *